US005924847A

United States Patent [19]

Scaringe et al.

[11] Patent Number: 5,924,847

[45] Date of Patent: Jul. 20, 1999

[54] MAGNETIC BEARING CENTRIFUGAL REFRIGERATION COMPRESSOR AND REFRIGERANT HAVING MINIMUM SPECIFIC ENTHALPY RISE

[75] Inventors: Robert P. Scaringe; Fulin Gui, both of Rockledge; Scott M. Benedict, Melbourne, all of Fla.

[73] Assignee: Mainstream Engineering Corp., Rockledge, Fla.

[21] Appl. No.: 08/908,035

[22] Filed: Aug. 11, 1997

[51] Int. Cl.[6] ..... F04B 49/00

[52] U.S. Cl. ..... 417/42; 62/498; 62/408

[58] Field of Search ..... 62/498, 408; 261/140.1; 417/42

[56] References Cited

U.S. PATENT DOCUMENTS

| | | | |
|---|---|---|---|
| 4,302,150 | 11/1981 | Wieland | 415/207 |
| 4,523,896 | 6/1985 | Lhenry et al. | 417/244 |
| 4,708,593 | 11/1987 | Banyay | 416/183 |
| 4,809,521 | 3/1989 | Mokadam | 62/498 |
| 4,889,039 | 12/1989 | Miller . | |
| 5,065,590 | 11/1991 | Powell et al. . | |
| 5,127,792 | 7/1992 | Katsuta et al. . | |
| 5,145,317 | 9/1992 | Brasz | 415/224.5 |
| 5,152,679 | 10/1992 | Kanemitsu et al. . | |
| 5,277,834 | 1/1994 | Bivens et al. | 252/67 |
| 5,312,226 | 5/1994 | Miura et al. . | |
| 5,355,042 | 10/1994 | Lewis et al. . | |
| 5,355,691 | 10/1994 | Sullivan et al. | 62/201 |
| 5,445,494 | 8/1995 | Hanson . | |
| 5,553,997 | 9/1996 | Goshaw et al. . | |
| 5,600,076 | 2/1997 | Fleming et al. | 73/865.9 |
| 5,729,066 | 3/1998 | Soong et al. | 310/90.5 |
| 5,747,907 | 5/1998 | Miller | 310/90 |

OTHER PUBLICATIONS

"Thermodynamics", Wark, K. McGraw Hill, 1977, 3rd. ed.

"Refrigeration Systems" Corinchock, J.A. McGraw Hill, 1997.

"Compressors" Brown, R.N. Gulf Publishing, 1986.

Zero–ODP Refrigerants for Low Tonnage Centrifugal Chiller Systems; F. Gui et al., 7 pages.

Design and Experimental Study of High–Speed Low–Flow–Rate Centrifugal Compressors; F. Gui et al.; IECEC Paper No. CT–39, ASME 1995, pp. 35–41.

High Efficiency Low Flow Rate Centrifugal Compressor for The More Electric Aircraft; F. Gui et al., SAE Technical Paper Series 942185, Oct. 1994, 8 pages.

Lubrication Free Centrifugal Compressor; J. Gottschlich et al., 5 pages.

Performance Evaluation of Small Centrifugal Compressors For Application in Air–Cycle Power and Refrigeration Systems, M. Rahman et al., SAE Technical Paper Series 941148, Apr. 1994, 6 pages.

*Primary Examiner*—Charles G. Freay
*Assistant Examiner*—Daniel E. Moses
*Attorney, Agent, or Firm*—Evenson, McKeown, Edwards & Lenahan, P.L.L.C.

[57] ABSTRACT

A vapor compression refrigeration system, such as a water chiller, uses a centrifugal compressor with magnetic bearings and a refrigerant, specifically HFC-227ea and HFC-227ca, to minimize enthalpy rise across the compressor and/or provide compression in a single stage for low cooling capacity. Magnetic bearings eliminate the problem caused by lubricated bearings to support rotating structure during normal compressor operation. The centrifugal compressor can be configured with a pre-defined static surge line.

31 Claims, 8 Drawing Sheets

MAGNETIC BEARING CENTRIFUGAL REFRIGERATION COMPRESSOR AND REFRIGERANT HAVING MINIMUM SPECIFIC ENTHALPY RISE

BACKGROUND AND SUMMARY OF THE INVENTION

The present invention relates generally to an apparatus for vapor compression refrigeration systems, and more particularly, to an apparatus for water chiller refrigeration systems, a high-speed centrifugal compressor for such systems and a refrigerant for use in such systems. That is, the present invention is directed to an improved direct drive centrifugal refrigeration compressor which uses magnetic bearings to support the rotor structure and to an improved refrigerant suited to such a compressor.

A conventional centrifugal water chiller, shown schematically in FIG. 1, typically consists of the following components: an evaporator 101 (a heat exchanger which boils liquid refrigerant at a low pressure to cool circulating water), a compressor to raise the pressure of the resulting vapor, a water cooled condenser 102 (a heat exchanger which liquifies the compressed vapor at a high pressure rejecting the heat to a second circulating water loop), and an expansion device 103 which lowers the pressure of the liquid refrigerant allowing it to evaporate at a lower temperature.

The refrigerant pressure within the evaporator 101 and the condenser 102 are determined by the thermophysical properties of the particular refrigerant as well as the temperatures at which the boiling and condensation processes within the heat exchangers are designed to occur. For typical water chiller applications with water cooled condensers, the liquid refrigerant temperature within the evaporator is approximately 40° F. and the liquid refrigerant temperature within the condenser is approximately 95° F.

In a water chiller system, the compressor acts as a vapor pump, raising the pressure of the refrigerant from the evaporating pressure (the saturation pressure corresponding to the liquid refrigerant temperature) to the condensing pressure (the saturation pressure corresponding to the liquid refrigerant temperature). Existing compressors perform this process, specifically rotary, screw, scroll, reciprocating, and centrifugal compressors. Each compressor has advantages for various purposes in different cooling capacity ranges. For cooling capacities exceeding 140 tons, centrifugal compressors have been shown to yield the highest isentropic efficiency and therefore the highest overall thermal efficiency for the chiller refrigeration cycle. In general terms, a centrifugal refrigeration compressor consists of the following components: inlet guide vanes, one or more impellers within a housing surrounded by one or more diffusers with collectors driven by some mechanical shaft apparatus such as an engine or electric motor.

After passing over the inlet guide vanes, refrigerant vapor enters the impeller through the inlet in the compressor housing. When the impeller rotates, the refrigerant vapor is drawn axially into the passages formed on three sides by the rotating impeller hub and blades and on the fourth side by the stationary housing. The clearance between the rotating impeller and the stationary housing is made as small as practicable to minimize the leakage of vapor out of the passage. The rotation of the impeller imparts kinetic energy to the vapor which increases both the velocity and the static pressure of the refrigerant. The vapor is discharged from the impeller with significant velocity into the diffuser which lies in a radial plane perpendicular to the axis of rotation.

The vapor velocity contains both a radial component associated with the mass flow through the compressor and a tangential component imparted by the rotation of the impeller. The diffuser vanes direct the flow in aerodynamically-configured channels for highly efficient diffusion in limited space. The vapor decelerates due to the expansion of the flow area that naturally accompanies the increase in radius of the constant thickness diffuser passage. The deceleration of the flow results in the conversion of the kinetic energy of the vapor into additional static pressure rise. The vapor is discharged from the diffuser with a much lower velocity into the collector. The collector channels the fluid from the diffuser to the compressor outlet. Further deceleration of the flow due to the gradual expansion of the collector area results in additional static pressure rise. The fluid is discharged from the compressor through the outlet in the compressor housing.

In a centrifugal compressor, flow rate and pressure rise cannot be independently controlled. At a constant compressor speed, variable position inlet guide vanes allow modulation of the flow rate through the compressor. As the inlet vane angle increases, the flow rate through the compressor decreases, and the required torque and power input also decrease. The decrease in refrigerant vapor flow rate causes a decrease in the cooling capacity of the evaporator. In this way, the cooling capacity in a system such as a water chiller can be modulated to match the cooling load.

It has been widely recognized that the specific speed (a non-dimensional ratio of the flow rate to pressure rise behavior for centrifugal compressors) can be correlated to compressor isentropic efficiency and indirectly therefore to overall cooling system efficiency. High isentropic compression efficiencies have been demonstrated for compressors with specific speeds in the range from 0.8 to 1.2. The pressure ratio across a centrifugal compressor is a function of the tip speed, the product of the rotating speed and the compressor exit diameter. The flow rate through the compressor is largely a function of the inlet diameter and rotating speed. The specific speed represents, in part, a non-dimensional ratio of the inlet diameter to the outlet diameter, a factor in the compressor geometry.

The tip speed for a single stage centrifugal compressor is determined by the pressure ratio required to raise a particular refrigerant from the pressure corresponding to the evaporating refrigerant temperature to the pressure corresponding to the condensing refrigerant temperature. For conventional refrigerants operating at moderate shaft speeds (10,000 to 15,000 rpm) large diameter impellers are required to generate adequate tip speed. The large diameter impellers have large inlet areas and consequently high refrigerant flow rates and large minimum design evaporator cooling capacities. Minimum design cooling capacity is defined as the minimum cooling capacity at full load that corresponds to the smallest specific speed possible for a single stage unit at specified rotating speed and refrigerant temperature lift.

It has also been recognized that centrifugal compressors with smaller minimum capacities require higher rotating speeds. The higher rotating speed yields the desired pressure ratio for refrigeration in a small impeller with a small inlet diameter with a small flow rate and low minimum design cooling capacity. The advantage of extending the lower achievable minimum design cooling capacity is an advantage that centrifugal compressors have over other compression technologies. Shaft speeds in current centrifugal chillers have been limited to around 15,000 rpm for mechanical causes. Higher shaft speeds require tighter design and assembly tolerances, better shaft balancing, more reliable lubrication, etc. This results in much higher costs.

A typical known centrifugal compressor of the type shown schematically in FIG. 1 also contains a rotor with one or more impellers surrounded by a casing, bearings to support the rotating structure, and a prime mover such as an engine, turbine, or electric motor. Compressors can also contain speed increasing gear trains to convert low speed driver motion to high-speed impeller motion, oil pumps, oil filters, oil separators, heaters for lubricant flow, and moving seals to contain the refrigerant vapor within the casing.

The basic illustrated elements include the high speed impeller 104 mounted on a high speed shaft 105 which is supported by two or more bearings 106 of the journal type which ride on a lubricant film or of the rolling element type. The thrust load generated by unbalanced gas pressure on the impeller is absorbed by a thrust bearing 107 of the Kingsbury or tilting pad type which requires lubrication, or of the rolling element type. The high speed shaft is driven through a gear train consisting of a high speed 108 and low speed gears 109. The low speed shaft is supported on bearings and driven by a prime mover such as an electric motor 110 in this example. As a result of the use of either fluid film or rolling element bearings, an additional lubricant pump 111, lubricant filter 112 and lubricant cooler 113 are required. In machines with journal-type bearings, the pumps pressurize the lubricant before injection into the journal. In the case of rolling element bearings, the lubricant may be sprayed into the bearings in a mist.

The use of lubricant within a refrigeration compressor has several disadvantages. While providing necessary lubrication to bearings, the lubricant "contaminates" the tube wall of evaporators and condensers, thereby lowering the heat transfer coefficient, a critical thermal characteristic. To compensate for the lower heat transfer coefficient, either a large heat exchanger is required or large temperature differences for heat transfer need to be given. Increased temperature differences set a higher required temperature lift for a compressor, requiring the compressor to do more work to handle the consequences of lubrication.

The centrifugal compressor control system must also assure that the centrifugal compressor is not operated in a surge condition. Typical centrifugal compressors have a surge line that varies from machine to machine (due to minute manufacturing differences) and also varies over time due to various reasons such as machine wear or lubricant degradation of the refrigerant thermophysical properties. U.S. Pat. No. 4,608,833 to Kountz includes a learning mode which develops a dynamic surge line to account for the variation of the surge characteristics over time and between machines. Likewise U.S. Pat. No. 5,553,997 to Goshaw et. al. discusses a control system that dynamically determines the surge line of the centrifugal compressor.

Because of the disadvantages associated with the inability to generate efficient low flow rate centrifugal compressors due to low shaft speeds and for the disadvantages associated with the use of oil lubrication for centrifugal refrigeration compressors, we have recognized that there is a need for a lubricant free centrifugal compressor.

For definitional purposes, "magnetic bearings" are electromagnetic devices used for suspending a rotating body in a magnetic field without mechanical contact. The bearings can be further classified as active, i.e., requiring some type of control system to ensure stable levitation of the rotating body.

It is an object of the present invention to provide an apparatus which achieves efficient centrifugal refrigeration compression for typical operating conditions of water chiller systems and the like with a cooling capacity lower than previously obtainable. For definitional purposes, low cooling capacity centrifugal compression refrigeration systems refer to those systems with cooling capacities between 20 and 140 tons.

It is another object of the present invention to provide an improved centrifugal refrigeration compressor method and apparatus for water chiller applications.

Another object of the present invention is to provide improved minimum design cooling capacity in a refrigeration centrifugal compressor while maintaining high efficiencies over a broad stable operating range.

Another object of the present invention is to provide centrifugal compression which requires no lubrication of components, thereby reducing pumping, filtration, separation, heating, and plumbing hardware of prior art centrifugal refrigeration compressors. A resulting advantage is that removing lubricants from the compressor also reduces acids generated by chemical breakdown of the oil.

Another object of the present invention is to provide a refrigerant selection that allows compression from typical water chiller evaporator to condenser conditions in a single stage for low cooling capacity applications.

Still another object of the present invention is to provide bearings with diagnostic output of vibration, bearing forces, imbalance, etc.

Yet another object of the present invention is to provide an arrangement of components allowing the compressor to be directly driven by a high speed induction motor.

It is yet another object of the present invention to provide a control system which controls the operation of the bearings, inlet guide vane position, and motor speed to maximize compressor efficiency.

It is yet another object of the present invention to provide a centrifugal compressor whose surge points do not vary over time, thereby allowing the use of a pre-defined static surge line for the compressor.

It is yet another object of the present invention to provide an improved capacity control system of a centrifugal compressor wherein the operating point of the compressor is placed on an established operating map. That is, the map is developed during the design of the centrifugal compressor and accounts for the refrigerant thermophysical properties, temperature lift, impeller and diffuser design, and operating speed, among other things. This operating map is not changed/modified during normal operation of the compressor. Yet another advantage of the present invention is that a dynamic operating map is not necessary, thereby reducing control system complexity, and cost while increasing control system reliability.

The centrifugal compressor of the present invention functions to compress refrigerant vapor from the evaporating pressure to the condensing pressure in a centrifugal water chiller and is specifically embodied in a single stage direct drive centrifugal type compressor whose rotor structure is supported by active magnetic bearings. As distinct from other centrifugal refrigeration compressors, the compressor of the present invention has been configured such that the pressure rise developed across the compressor for standard water chiller operating conditions yields a flow rate through the compressor which results in a minimum design cooling capacity smaller than other centrifugal refrigeration compressors known in the prior art.

In addition, as distinct from other known centrifugal refrigeration compressors, the compressor of the present invention uses magnetic bearings as the primary support for the rotor structure which yields substantial operational advantages. Moreover, as distinct from other known centrifugal refrigeration compressors, the compressor of the present invention is directly driven by a high speed induction motor.

More particularly, the centrifugal compressor of the present invention includes a compressor housing consisting of an impeller housing and a diffuser housing which when bolted together enclose a single impeller. The centrifugal compressor has an inlet guide vane system to control the flow of refrigerant into the impeller housing for the purposes of modulating the cooling capacity of the water chiller to which it is attached. The impeller is mounted in a cantilever manner on the compressor rotor. An induction motor for rotating the impeller is mounted on the same shaft. On either side of the motor element, radial magnetic bearings of the type well known to those skilled in the art support the compressor rotor. An axial bearing can also be provided outside of each radial bearing. A digital magnetic bearing controller controls the operation of the bearings to maintain the compressor rotor in a stable position whether it is rotating or stationary. The induction motor speed is controlled by an inverter drive which converts the fixed 60 Hz frequency of typical electrical line power to a different frequency depending on the desired motor speed.

A currently preferred embodiment of the present invention in the form of a magnetic bearing centrifugal compressor, does not exhibit a surge line which changes or degrades over time or between like machines. Because the surge characteristic does not vary, a single surge line can be used instead of continuously calculating a "moving" surge line as the machine operates as has been done in the past. The line of the present invention does not change because the system has no lubricant which degrades over time or causes the degradation of the refrigerant's thermophysical properties. The position of the impeller relative to the stationary diffuser is maintained at a prescribed location by the magnetic bearing controller, so there is no bearing wear leading to changes in the relative position of these components. Variations in the dynamics of the rotating components over time, are automatically compensated for by electronically re-tuning the bearing during periodic maintenance checks.

The centrifugal compressor of the present invention achieves lower minimum design cooling capacities than prior centrifugal compressors have been capable of achieving in a single impeller stage by increasing shaft speed. Furthermore, the present invention allows for the removal of oil lubrication and its associated pumping, filtration, plumbing, separation and heating hardware found on conventional chillers by using magnetic bearings which have no wear and require no lubrication.

The centrifugal compressor of the current invention reduces mechanical complexity, the number of moving parts, and total compressor volume by using a high speed direct drive AC induction motor powered by a high frequency inverter drive. Of course, it will be understood that, in light of the teachings of the present invention, one skilled in this art will now be able to make changes and modifications without departing from the principles of the present invention.

Yet another aspect of the present invention involves the selection of the refrigerant used in the vapor compression refrigerant system. We have found that the consideration of minimum enthalpy rise across the compressor results in the selection of refrigerants having superior characteristics, particularly in the selection of HFC-227ea and HFC-227ca for use in water chiller systems employing a high-speed centrifugal compressor.

BRIEF DESCRIPTION OF THE DRAWINGS

Other objects, advantages and novel features of the present invention will become apparent from the following detailed description of the invention when considered in conjunction with the accompanying drawings wherein.

DETAILED DESCRIPTION OF THE DRAWINGS

Figure 1:
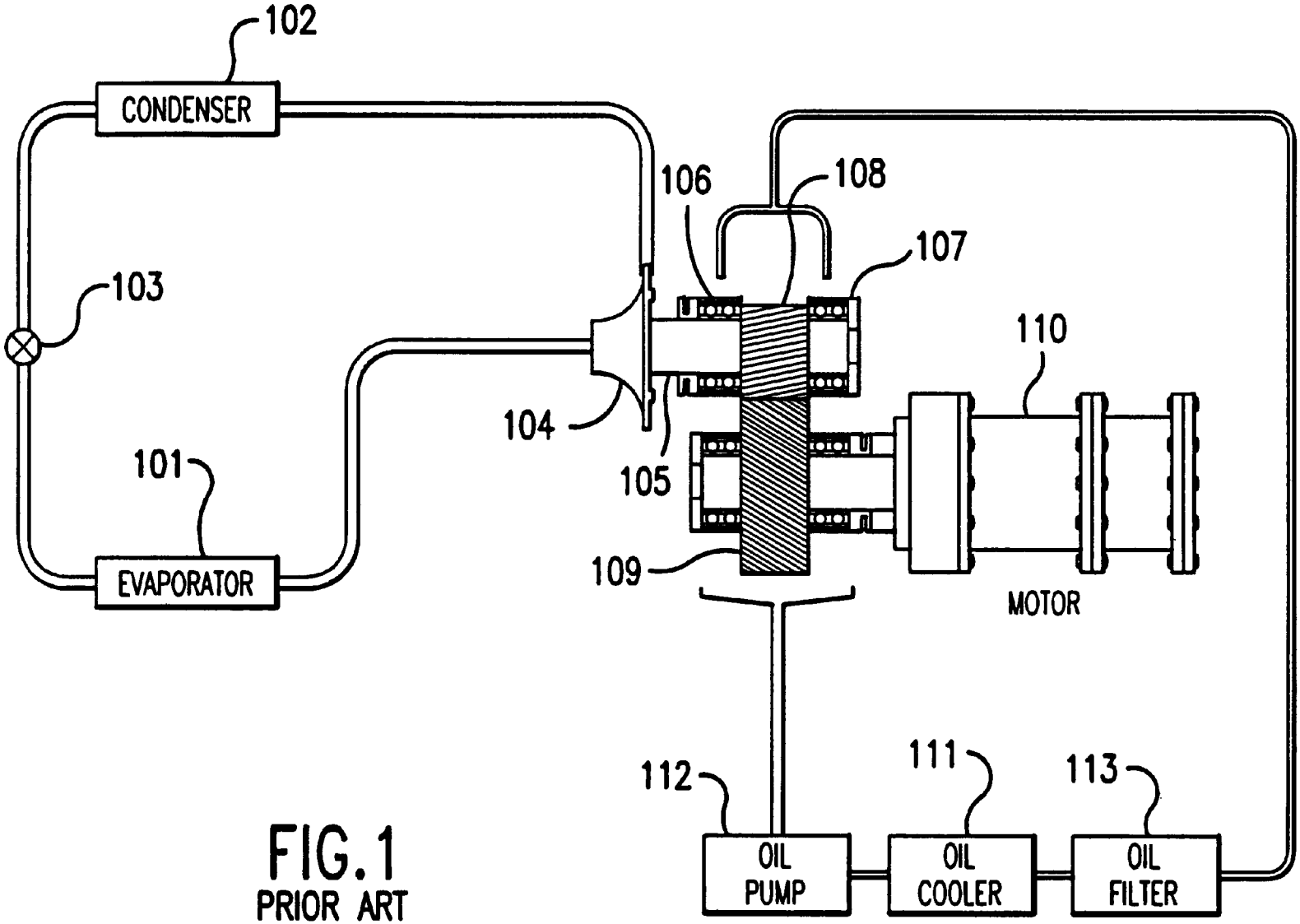
FIG. 1 PRIOR ART
FIG. 1 is a schematic view of a vapor compression refrigeration system (e.g. water chiller) incorporating a conventional centrifugal refrigeration compressor.

A schematic view of a conventional water chiller system, consisting of an evaporator, compressor, condenser, and expansion device has already been discussed with reference to FIG. 1. A critical component of the chiller system is the centrifugal refrigeration compressor which increases the pressure of the refrigerant vapor from the saturation pressure of the refrigerant in the evaporator to the saturation pressure of the refrigerant in the condenser.

The efficiency of the water chiller system is typically specified as ratio of the electrical power input to the cooling capacity within the evaporator. The cooling capacity of the evaporator is a function of the flow rate of refrigerant through the evaporator and the latent heat of vaporization of the refrigerant. The power input to the compressor is a function of the pressure ratio across the compressor (the ratio of refrigerant condensing pressure to evaporating pressure) , the flow rate of refrigerant through the compressor, and a series of geometric and operational design parameters.

For centrifugal compressors, tip speed, which is the product of impeller diameter and rotating speed, is the primary factor which determines pressure ratio across the compressor. Centrifugal compressors which have refrigerants with high head rises must have correspondingly large tip speeds. Large tip speeds require either large diameter impellers operating at moderate speeds or small diameter impellers operating at large speeds or some intermediate combination of diameter and speed.

For centrifugal compressors, however, impeller inlet diameter is the primary factor which determines flow rate through the compressor. It is already known that there are optimum ratios of impeller inlet diameter to outlet diameter, and indirectly flow rate to pressure ratio, that yield efficient isentropic compression. With pressure ratio specified by the selection of refrigerant and evaporating and condensing temperatures, by optimum efficiency determined by the ratio of inlet diameter to outlet diameter, and by mechanical factors favoring larger diameter impellers operating at slower speeds, centrifugal compressors have been limited to large refrigerant flow rate applications. As a result, certain minimum design cooling capacities have not been attainable with commonly used refrigerants.

Several zero-ozone depletion potential HFC refrigerants, including HFC-134a, HFC-227ca, HFC-227ea, HFC-236ea, HFC-236cb, HFC-236fa, HFC-245cb, and HFC-254cb, have been proposed for use in centrifugal chiller applications. Table 1 below summarizes important thermal properties of common refrigerant for water chillers and the like, and compares the minimum design cooling capacities for the refrigerants mentioned above for common water chiller operating conditions and a specified specific speed representing a typical centrifugal compressor configuration known in the prior art for high isentropic efficiency.

the table. By using magnetic bearings instead of conventional bearings, we have discovered that it is now practical to raise the compressor speed significantly above that currently achievable in centrifugal refrigeration compressors. As a result, HFC-236ea and HFC-227ea exhibit nearly identical curves, with HFC-236ea being slightly lower.

HFC-227ea has a low enthalpy rise from typical evaporator to condenser conditions relative to other refrigerants. As can be seen in Table 1, the refrigerants with the lowest isentropic enthalpy rise, $h_{ad,s}$, namely HFC-227ea and HFC-227ca, also exhibit the lowest pressure ratio. This characteristic holds for a wide range of operating conditions. Low enthalpy rise refrigerants yield advantages in centrifugal compressor design which include a reduced impeller tip speed and a smaller impeller diameter. It has been demonstrated that low enthalpy rise refrigerants may also yield improvements in compressor efficiency by reducing flow losses due to lower vapor velocities in the impeller and diffuser, a reduced degree of diffusion in the impeller, and lower frictional losses. Low flow velocity can effectively avoid high turbulent and flow separation losses occurring in a compression process that reduce its efficiency.

To analyze the comparative performance of refrigerants, a model of the water chiller cycle was developed that assumed a constant compressor efficiency (the most common technique for trade studies of refrigerant performance), a constant rotating speed, and a constant loading coefficient. As shown in Table 1, HFC-236ea has a COP slightly larger than HFC-227ea when the compressor efficiency is assumed constant. However, as mentioned earlier, higher compressor efficiencies are available with HFC-227ea due to aerodynamic factors and the lower overall required enthalpy rise.

Although a normal thermal cycle analysis would focus on the selection of a refrigerant with a high coefficient of performance, we have found that other factors make a

TABLE 1

| Refrigerant | Evap Press $p_e$ (kPa) | Press Ratio $p_c/p_e$* | Unit Cooling $\Delta h_e$ (kJ/kg) | Isen Enth Rise $h_{ad,e}$ (kJ/kg) | COP, $\eta$ = 75 $\Delta T_{sub}$ = 5° C. | Min Cool Ca $Q^+_{e,min}$* |
|---|---|---|---|---|---|---|
| CFC-11 | 47.2 | 3.40 | 158.4 | 20.73 | 5.897 | |
| CFC-114 | 103.6 | 3.06 | 100.8 | 14.51 | 5.476 | 1.00 |
| CFC-123 | 40.9 | 3.59 | 142.0 | 19.59 | 5.642 | |
| HFC-134a | 344.2 | 2.79 | 146.2 | 20.74 | 5.576 | 5.17 |
| HFC-227ca | 223.7 | 2.78 | 79.3 | 12.25 | 5.223 | 1.37 |
| HFC-227ea | 243.4 | 2.78 | 78.6 | 12.19 | 5.204 | 1.47 |
| HFC-236cb | 127.0 | 3.07 | 111.4 | 16.15 | 5.447 | 1.43 |
| RFC-236ea | 92.5 | 3.38 | 124.9 | 17.98 | 5.475 | 1.35 |
| RFC-236fa | 125.6 | 3.09 | 112.5 | 16.31 | 5.451 | 1.45 |
| RFC-245cb | 243.5 | 2.79 | 105.0 | 15.83 | 5.308 | |
| HFC-254cb | 123.6 | 3.01 | 148.3 | 21.15 | 5.517 | |

*For a cycle of temperature lift from 4.44° C. to 37.8° C. (40° F. to 100° C.)
The compressor efficiency is assumed to be 0.75 for all refrigerants.

As Table 1 shows, the minimum cooling capacity for the 236 and 227 class refrigerants is much smaller than for other HFC class refrigerants. For typical water chiller operating conditions, the 236 class of refrigerants yields an evaporating pressure that is below atmospheric pressure, necessitates the use of a purge system for noncondensable gases which leak into the system, and requires a high impeller tip speed or a large impeller diameter. Consequently, the 236 and 227 class has been considered unacceptable in the past for use in typical water chiller operating conditions.

Figure 2:
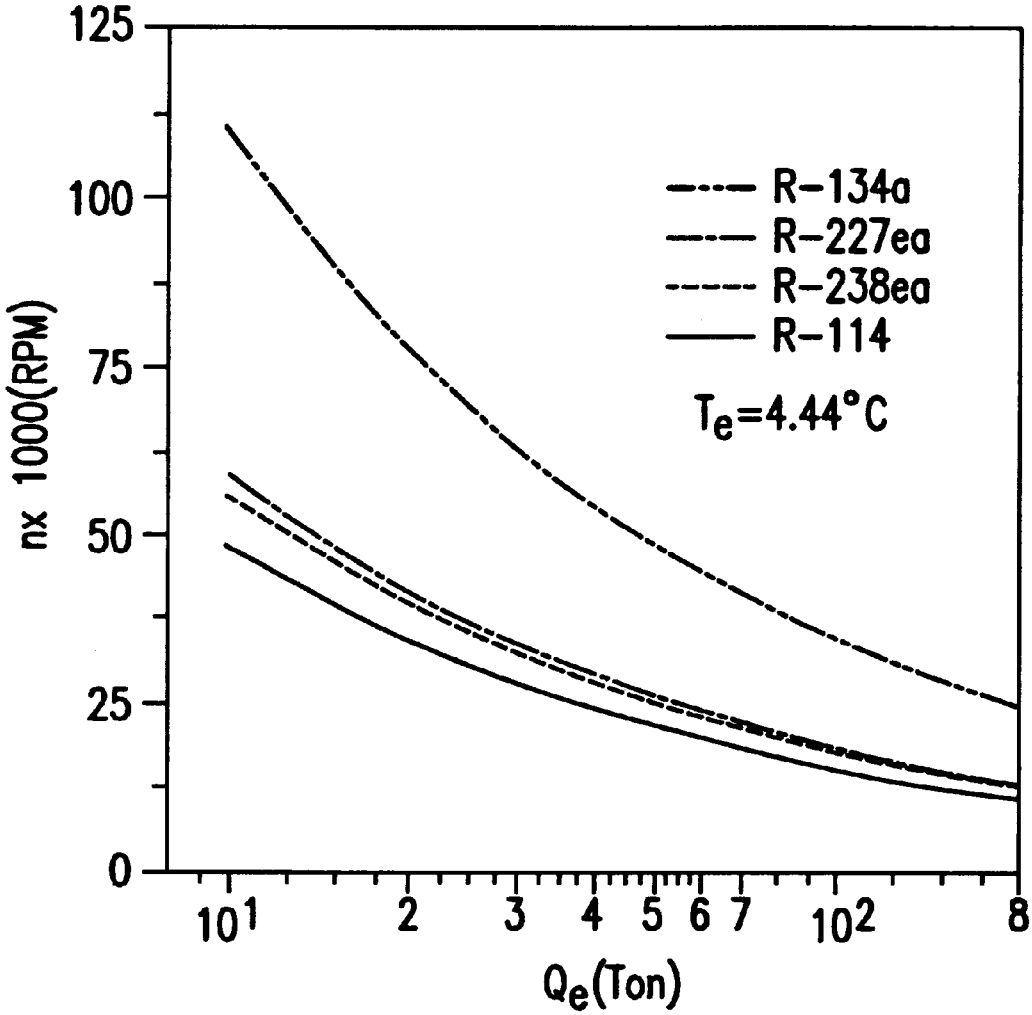
FIG. 2 is a graph showing the minimum design cooling capacity for common refrigerants at typical water chiller evaporating and condensing conditions comparing refrigerant performance in a standard model.

As has been already mentioned, the provision of efficient low cooling capacity centrifugal compressors requires the compressor rotating speed to be increased. FIG. 2 displays the reduction in the minimum cooling capacity which results from increased compressor speed for several refrigerants in difference in the selection of the optimum refrigerant for a centrifugal chiller application. The difference in compressor efficiency needed to yield identical COP's for the refrigerants (HFC-236ea and HFC-227ea) is less than 4%. Considering the 48%. difference in the enthalpy rise between HFC-227ea and HFC-236ea, and the more than 20% difference in impeller diameter, the frictional losses, accounted for aerodynamically, for HFC-227ea are significantly less than those HFC-236ea yielding a greater than 4% difference in compressor efficiency. This is due to the impeller's friction loss being proportional to the cubic power of the impeller diameter, which is smaller for HFC-227ea. In addition, the higher operating pressure of a HFC-227ea system reduces the significance of the flow resistance (pressure drop) in the system when compared with HFC-236ea. For the same frictional pressure drop, the performance drops more for HFC-236ea than for HFC-227ea.

Figure 3:
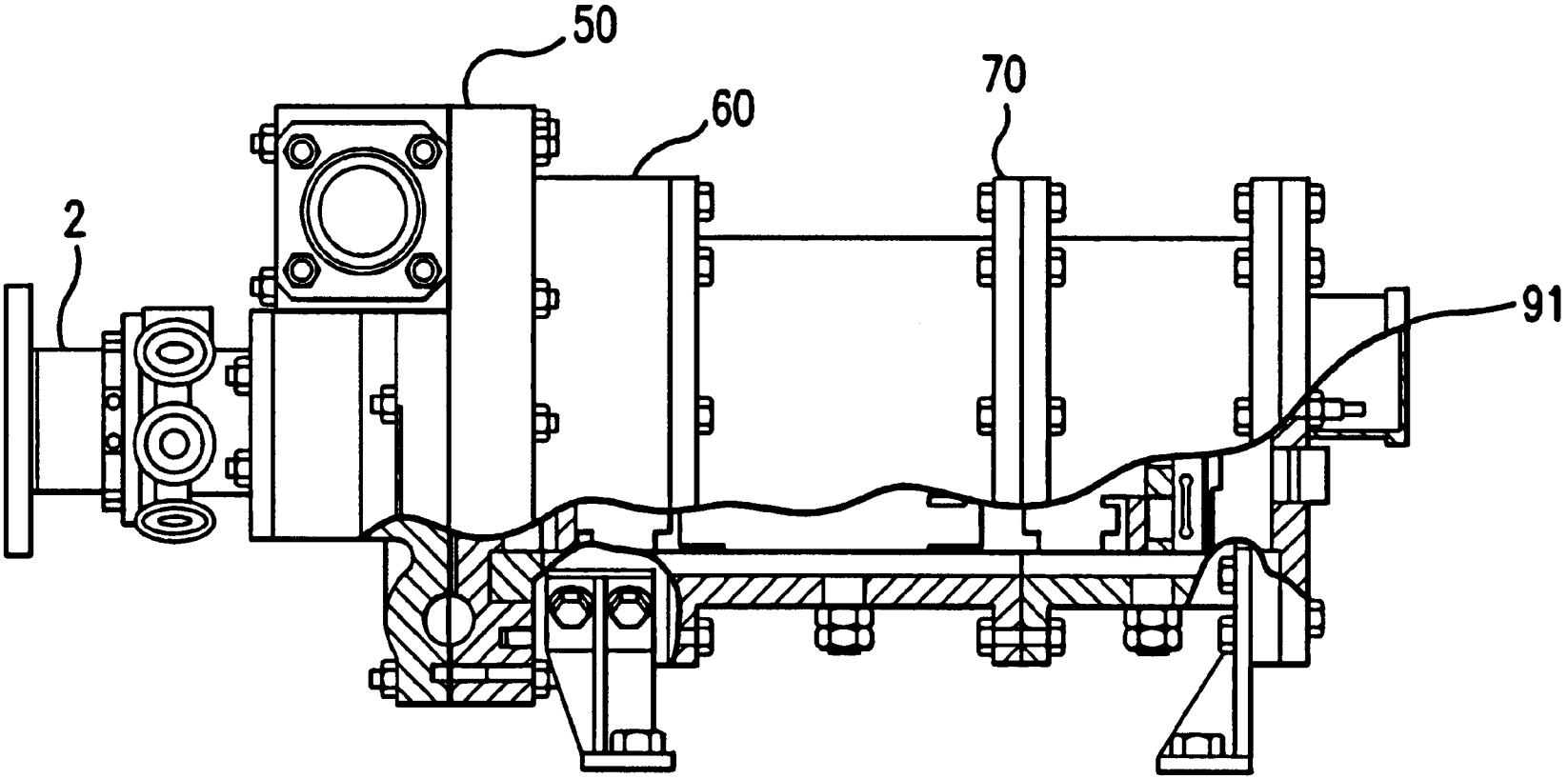
FIG. 3 is a partial cross sectional view of one currently contemplated embodiment of a centrifugal compressor according to the present invention.
Figure 3A:
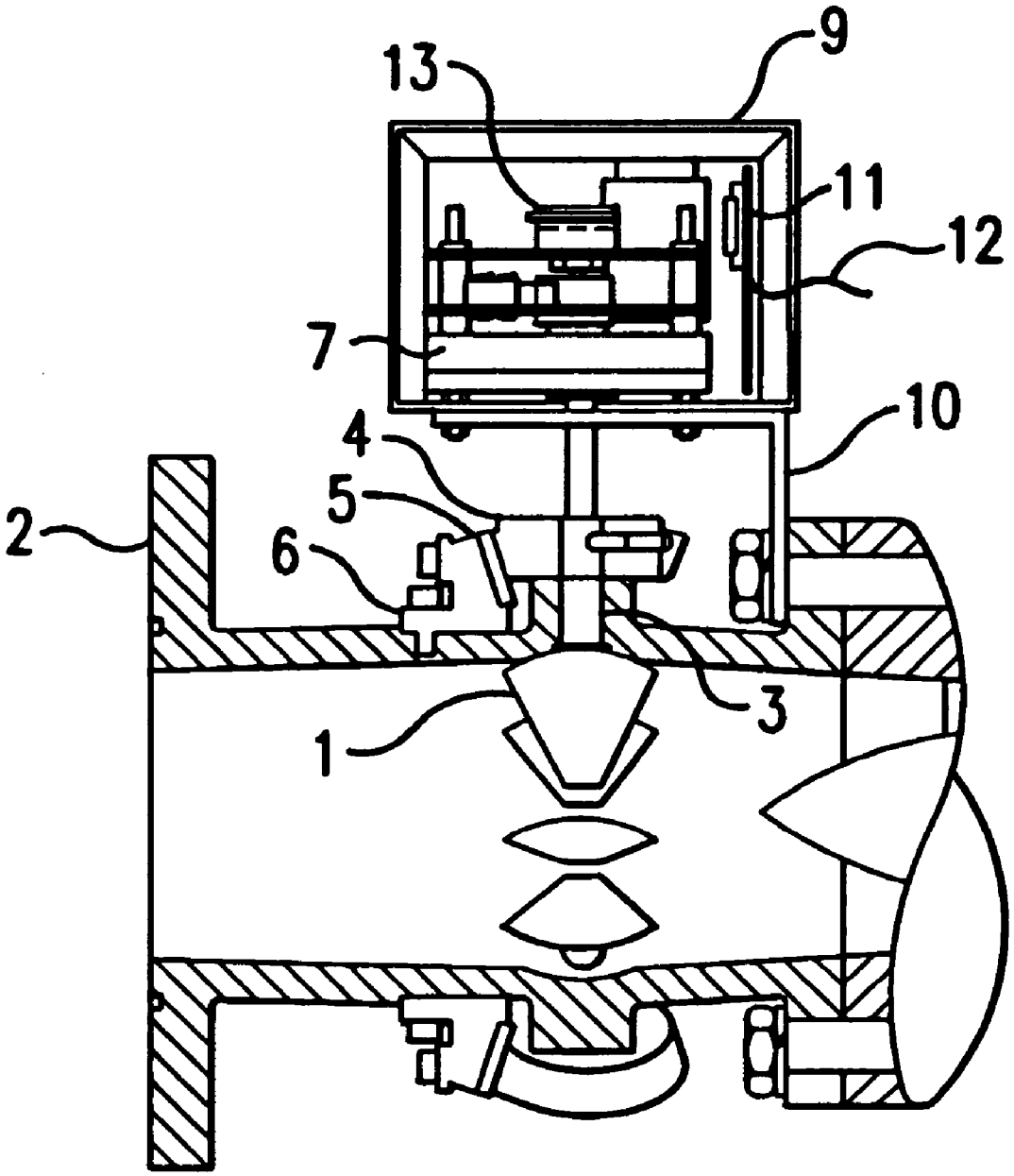
FIG. 3*a* is a cross-sectional elevation view of the inlet guide vane section of the centrifugal compressor shown in FIG. 3 but showing the features of the inlet guide vane assembly and the vane actuation assembly on a larger scale.
Figure 3C:
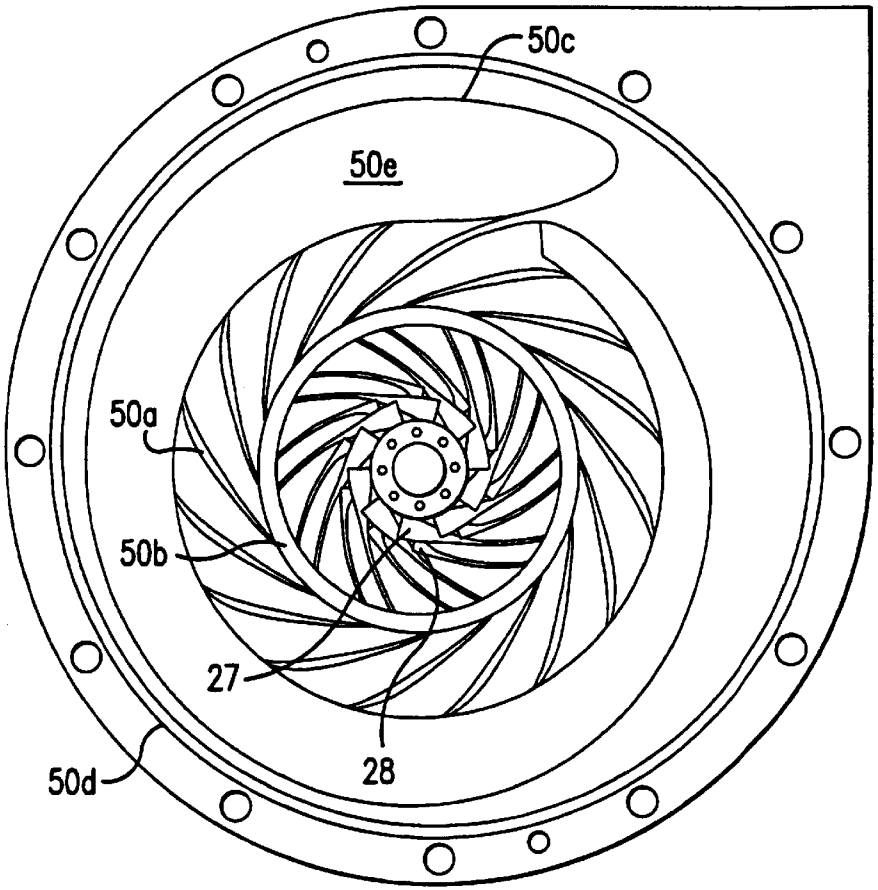
FIG. 3*c* is a view of the impeller and diffuser plate of the compressor section as viewed in the direction of arrow A in FIG. 3*b;*
Figure 3B:
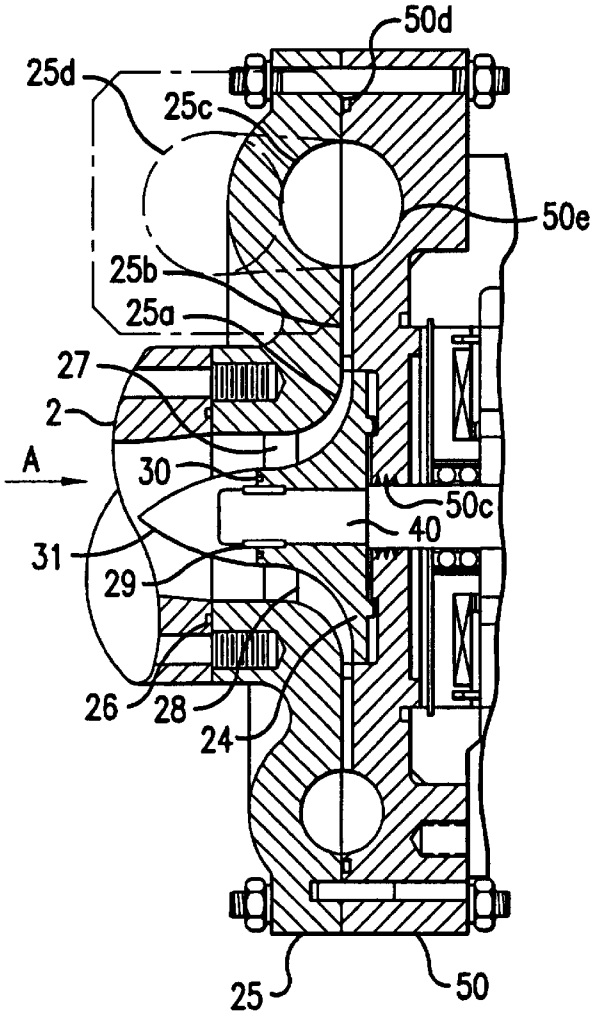
FIG. 3*b* is a cross-sectional elevation view of the compressor section of the present invention showing the features of the impeller, impeller housing, and diffuser housing in greater detail.
Figure 3E:
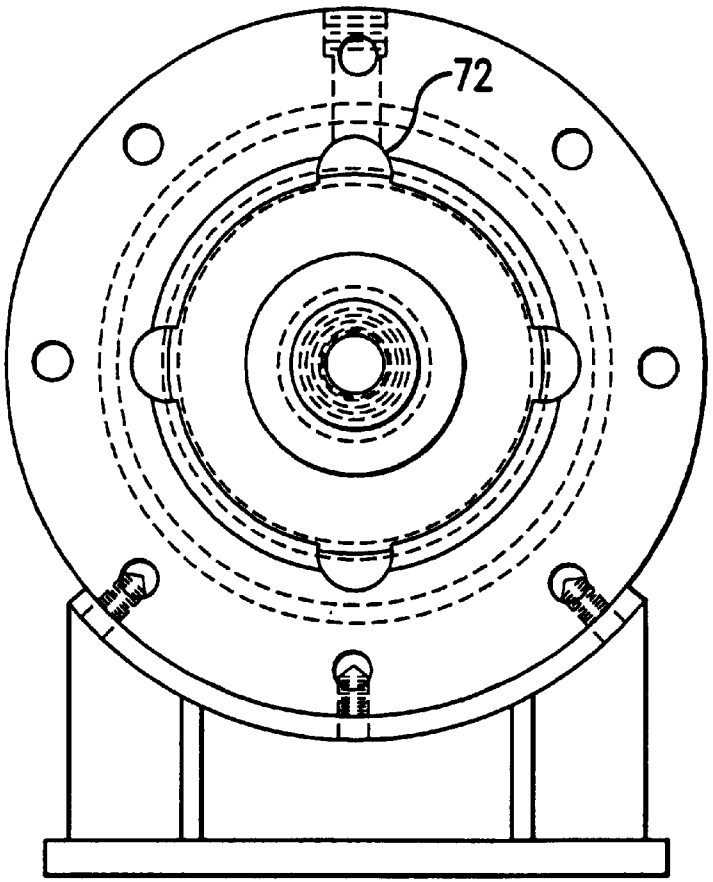
FIG. 3*e* is an end view of the drive end radial bearing assembly looking in the direction of arrow B in FIG. 3*d;*
Figure 3D:
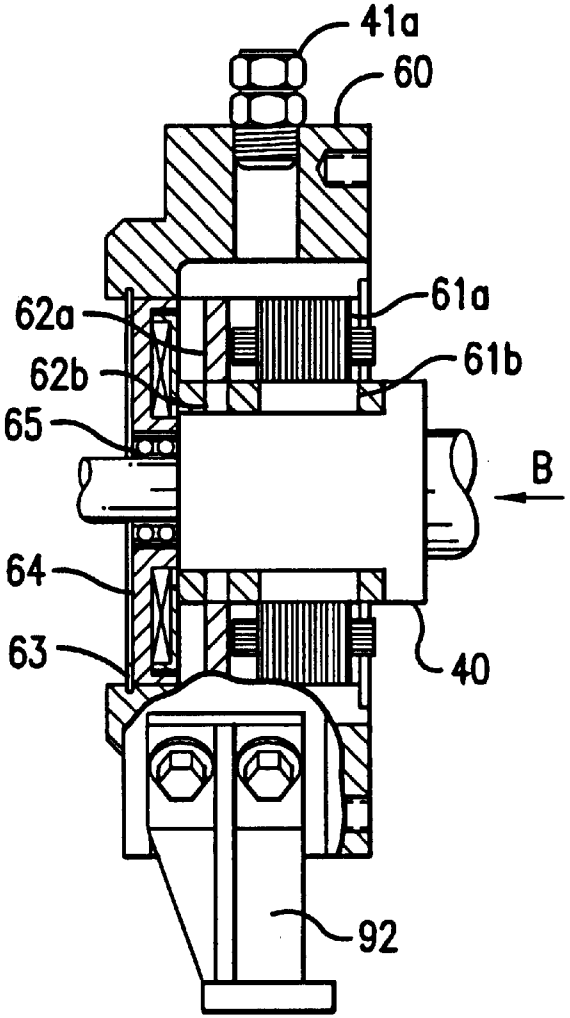
FIG. 3*d* is a partial cross-sectional elevation view of the drive end radial bearing assembly of the centrifugal compressor shown in FIG. 3 but showing the interior components on a larger scale.
Figure 3F:
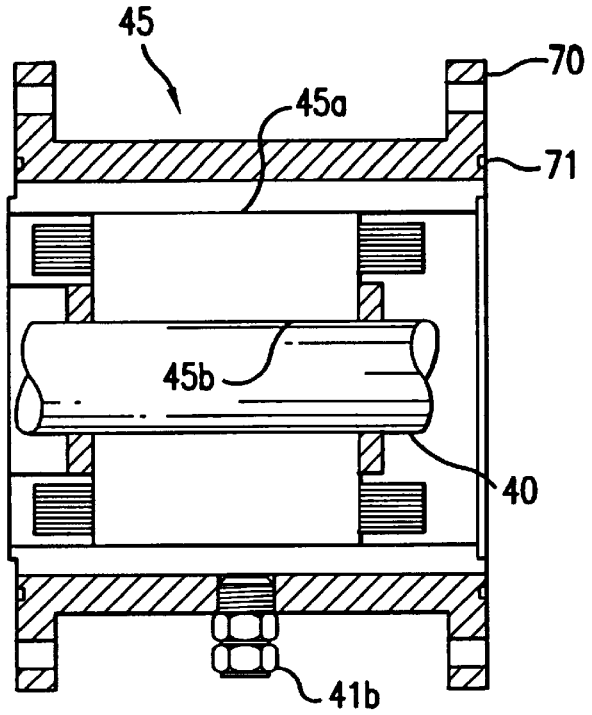
FIG. 3*f* is a partial cross-sectional view of the motor housing showing the motor stator and rotor.

A partial cutaway of the preferred embodiment of a single stage direct drive magnetic bearing centrifugal refrigeration compressor for low cooling capacity centrifugal chillers, which uses as its refrigerant HFC-227ea is shown in FIGS. 3 through 3*f*. The apparatus comprises three main sections, an inlet guide vane section, a compressor section, and a magnetic bearing AC induction motor section. Various attendant views are shown as lettered additions to FIG. 3. The apparatus is controlled by a compressor control system, the operation of which is shown schematically in FIG. 4.

Inlet Guide Vane Section

Inlet Guide Vane Assembly

The low temperature refrigerant vapor formed in the evaporator first passes through the inlet guide vane assembly shown in greater detail in FIG. 3*a*. A plurality of guide vanes 1 are surrounded by a guide vane housing 2 through which the guide vane stems protrude. The guide vanes 1 have an aerodynamic airfoil shape with a slight twist from the root of the blade to the tip. The twist compensates for the slightly increased mean velocity of a fully developed inlet vapor flow expected at the center of the guide vane housing 2 to maintain the angle of attack of the incoming refrigerant vapor constant along some length of the vane leading edge. Both the guide vane leading and trailing edges have a smooth rounded profile to reduce separation losses at the inlet to the compressor.

The refrigerant vapor enters the casing from the left as seen in FIG. 3*a* and flows through the guide vane housing 2 into the compressor section to which the guide vane assembly is attached. The refrigerant vapor is sealed within the guide vane housing by O-ring seals 3 along each guide vane stem. When in the fully open position, as depicted in FIG. 3*a*, the refrigerant vapor flow rate is at a maximum through the apparatus. When in the fully closed position, the refrigerant vapor flow rate is at a minimum. However, the guide vanes 1 do not extend to the center of the guide vane housing and therefore do not completely block the refrigerant vapor flow when in the fully closed position.

A beveled pinion gear 4 is mounted to each guide vane stem exterior to the guide vane housing. The pinion gear is operatively arranged and indexed so that in the fully open position, when the set of guide vanes 1 are parallel to the flow, the index marks of the set of pinion gears are aligned. The pinion gear engages a single beveled rack drive gear 5 which engages all other pinion gears in the set. The rack drive gear 5 rotates around the guide vane housing 2 causing the guide vanes to open or close depending on the direction of rotation. Stops secured to the guide vane housing prevent rotation of the vanes beyond the fully open, 0°, or fully closed, 90°, position. The base of the rack drive gear slips smoothly along a plurality of gear pads 6 positioned around and secured to the guide vane housing.

Vane Actuator Assembly

The position of the inlet guide vanes is controlled by the vane actuator assembly which comprises a commercially available high torque gear motor 7. The shaft of the gear motor 7 is secured to one of the guide vane stems such that the axis of the shaft and the axis of the guide vane stem are coaxial. The vane actuator housing 9 which contains the gear motor 7 and the other components of the vane actuator assembly is secured to one end of the vane actuator housing bracket 10, the other end of which is fastened to the guide vane housing 2 to provide a firm base for the vane actuator assembly.

Inside the vane actuator housing 9 a vane actuator circuit board 11, the design concepts of which are familiar to someone skilled in the art of electronics, converts one of a plurality of incoming guide vane position signals 12 into an electrical signal which controls the angular position of the gear motor. A potentiometer 13 secured to the non-drive end of the gear motor shaft provides an outgoing guide vane position signal as feedback to the chiller system controller. The purpose of the guide vane assembly and the attached vane actuator assembly is to adjust the flow of refrigerant into the compressor section for the purposes of modulating the cooling capacity of the chiller, as described previously.

Compressor Section

Impeller

After passing through the inlet guide vane section, refrigerant vapor enters the impeller 24 through the inlet port in the impeller housing 25 shown in more detail in FIGS. 3*b* and 3*c*. The inlet guide vane housing 2 is fastened firmly to the impeller housing 25 with cap screws, thereby compressing an O-ring seal 26 which prevents escape of refrigerant vapor through the interface between the components.

When the impeller rotates, the refrigerant vapor flows into ducts formed by the impeller hub surface, any two adjacent impeller blades 27 disposed circumferentially around the impeller hub, and the stationary impeller housing 25. The rotation of the impeller 24 imparts kinetic energy to the refrigerant vapor which increases both its velocity and static pressure.

Within each duct, shorter blade sections, known as splitter blades 28 form smaller passages through which the refrigerant vapor flows. Splitter blades ensure a reasonable static pressure load on each blade surface and reduce the potential for secondary flow, i.e., flow perpendicular to the axis of the passage. Mechanically, the impeller 24 is mounted to the compressor shaft 40. A round shaft key 29 prevents relative rotation between the impeller and the shaft 40 due to differences in the coefficient of thermal expansion between the materials. The impeller contains tapped holes on both the front and rear surfaces of the impeller hub for socket screw trim balance weights 30.

A feature of the unshrouded impeller of the present invention is its smaller size and consequently smaller mass relative to impellers of conventional design. The smaller size reduces the axial loads caused by unbalanced gas pressure and the radial loads caused by motion of the impeller center of mass about the bearing axis which are approximately proportional to the second and the third power of the impeller diameter respectively. The reduced loading allows bearings of smaller rated load size.

To prevent shock waves from occurring at the discharge, the impeller according to the present invention has a large reaction factor to maximize the static pressure rise from inducer to discharge. That is, the blades have a backsweep angle larger than 45 degrees (from the radial direction) at the trailing edge in order to enhance the diffusion within the impeller, yielding a greater static pressure and reduced refrigerant velocity at the discharge. The diffusion ratio, $w_1/w_2$, is at least 1.7. The diffusion ratio, a term well known to one skilled in the centrifugal compressor and related arts, defines the degree to which the vapor is expanded from the inlet conditions to the outlet conditions, as it travels from the small area inlet to the larger area outlet. The blade angle at the leading edge on the shroud side is greater than 25 degrees from the tangential direction. The relative Mach number is below 1.0 throughout the impeller at the design operating condition. Rounded blade leading edges show less blockage to the flow.

The refrigerant vapor is discharged through an outlet port in the impeller housing with significant velocity into the diffuser, a passage whose upper surface comprises the impeller housing 25 and whose lower surface comprises the diffuser housing 50. In the diffuser, the refrigerant vapor decelerates due to an increase in the cross-sectional flow area which accompanies the increase in radius of the constant thickness diffuser. The deceleration of the flow results in the conversion of the vapor's kinetic energy into additional static pressure rise. A plurality of cambered diffuser vanes 50*a* are arranged circumferentially around the periphery of the impeller in the diffuser housing 50. The diffuser vanes are disposed so that wide channels are formed without severe incident losses and separation. Each channel has a centerline which is tangential to the vapor flow from the impeller discharge and which forms a small angle to the centerline of the collector. The small diffuser discharge angle reduces the vapor mixing losses when entering the collector. While vaned diffusers typically have a narrow efficient operating range, the configuration of the present invention contains a vaneless space, i.e., the distance between the impeller periphery and the leading edge circle of the diffuser vanes 50*b*, between 6–12% of the impeller diameter which minimizes this effect.

Upon exiting the diffuser, the vapor enters the collector, a curved passage of steadily increasing area which leads to the outlet port. The vapor is discharged from the diffuser with a much lower velocity into the collector. The collector channels the fluid from the diffuser to the compressor outlet. Further deceleration of the flow due to the gradual expansion of the collector area results in additional static pressure rise.

Impeller Housing

Mechanically, the impeller housing 25 contains both the inlet and outlet ports for the refrigerant compressor. The impeller housing bore 25*a* has a profile shape which closely matches that of the impeller to provide close tolerances for maximum impeller pressure rise. The clearance between the rotating impeller and the stationary housing is made as small as practicable to minimize the leakage of vapor out of the passage. The tolerance dimension is controlled by the clearance available within the auxiliary "touchdown" bearings described below. The impeller housing forms a portion of the upper diffuser wall 25*b* at the end of the bore section. The impeller housing also contains a spiral-shaped collector groove 25*c* of steadily increasing diameter that, when mated with a similar groove on the diffuser housing, forms the collector for the compressor. The discharge duct starts at the end of the collector groove. The refrigerant exit passage 25*d* is angled away to a sufficient degree from the interface between the impeller housing and diffuser housing so that the exit passage penetrates the lateral surface of impeller housing midway from the inlet to the interface.

Diffuser Housing

The diffuser housing 50 is secured to the drive end radial bearing section 60 shown in FIGS. 3*d* and 3*e*. Holes tapped into the rear of the plate contain steel thread inserts to improve clamping force between the components. Circumferential V-shaped grooves (unnumbered) line the diffuser bore 50*c* through which the compressor shaft 40 protrudes. The grooves reduce the flow of refrigerant vapor into the motor cavity due to natural pressure differences within the system. An O-ring seal 50*d* contained in a groove machined in the motor housing forms a tight seal to prevent refrigerant vapor from escaping. The diffuser section contains the already described diffuser vanes along with the collector groove 50*e*. A precision rabbet fit on the rear face of the diffuser plate ensures precise alignment and concentricity of the diffuser plate to the drive end radial bearing section. Twelve clearance holes are provided for bolting the diffuser plate to the impeller housing using studs with flange face nuts to evenly distribute the clamping force. The front of the diffuser plate contains an O-ring groove for sealing the diffuser plate to the impeller housing.

AC Induction Motor Section

Motor

The compressor shaft is directly driven by a high speed induction motor 45 (FIG. 3*f*) consisting of a motor stator 45*a* mounted within the motor housing 70 and a motor rotor 45*b* secured to the compressor shaft 40. The motor 45 is configured to operate on either a 230 V or 460 V power supply, and for constant power operation over a range of speeds from 16,000 rpm to 30,000 rpm. Motor efficiency exceeds 92% over the constant power operating range. The squirrel cage motor rotor 45*b* is mounted with a shrink fit onto the compressor shaft 40. The motor windings are mounted within the motor housing 70 and secured axially with a retaining ring.

To dissipate heat generated by ohmic resistance losses in the motor stator, frictional heating of the refrigerant vapor in the air gap 45*c* and eddy current losses in the motor rotor 45*b* an evaporative refrigerant cooling system is provided as an effective method for high heat flux motor cooling. A plurality of cooling passages 72 are formed as grooves arranged circumferentially around the axis of the motor housing 70. Refrigerant vapor flows through the cooling passages 72 to remove heat generated by the aforementioned sources. The grooves permit heat to be taken away directly from where it is generated, thereby effectively decreasing the motor operation temperature and increasing the motor efficiency.

Variable Speed Drive

Figure 4:
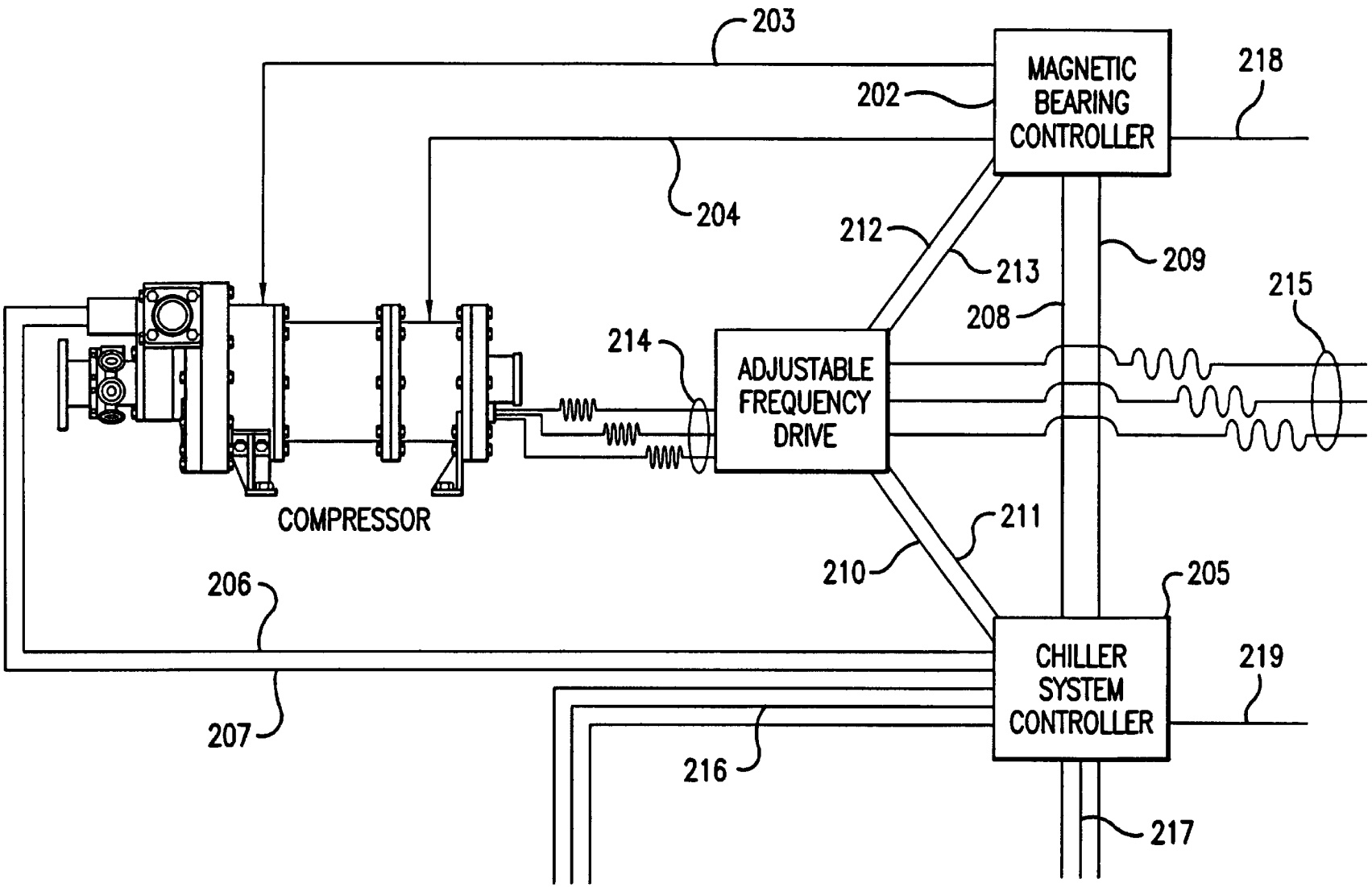
FIG. 4 is a schematic diagram showing the control system components of the compressor shown in FIG. 3.

The speed of the induction motor 45 is controlled by a commercially available adjustable frequency drive 201 shown schematically in FIG. 4. Three-phase power supplied to the adjustable frequency drive 201 allows variation of the motor speed from 18,000 to 30,000 rpm in the usable operating range. The adjustable frequency drive 201 is capable of 0–500 Hz operation with continuous frequency variation. It has PID control capabilities to maintain motor speed under varying load conditions. The feedback signal for the PID control is provided by a single pulse per revolution proximity sensor mounted inside the motor 45. The sensor generates a pulse on encountering the passage of a notch machined into the rotor 45*b*. The drive 201 provides capability for serial communication or interface with a PC using the RS-485 protocol. Through the serial interface, drive operation parameters such as line voltage, line current, and real power consumption can be read. In addition, the drive 201 provides capabilities for both digital and analog signal inputs and outputs through which its operation can be controlled remotely.

Radial Magnetic Bearings

Supporting the rotor structure in the vertical direction by electromagnetic force rather than by mechanical contact are two commercially available radial magnetic bearings 61*a*, 61*b* located one each on either side of the induction motor rotor 40. Each bearing is composed of a rotor 61*b* and stator 61*a* component. The stator consists of a stack of laminated ferromagnetic plates slotted on the internal diameter. The slots are arranged in pairs around the circumference with each pair centered on one of two axes rotated 45 degrees from the vertical direction. Additional slots are centered on the vertical and horizontal axes of the machine. Coils wound in each pair of slots and connected in series form electromagnetic poles in each of the four quadrants of the bearing. The rotor consists of a stack of laminated ferromagnetic plates mounted in a sleeve with a tapered bore that is shrink-fitted onto the compressor rotor. When electrical current flows through the stator coils, a magnetic flux circuit is formed and crosses the gap between the stator 61*a* and rotor 61*b*. The magnetic flux produces an attraction force which moves the rotor and supports the compressor rotor 40.

Axial Magnetic Bearing

Supporting the rotor structure in the horizontal direction by electromagnetic force rather than by mechanical contact is an axial magnetic bearing composed of two stator sections 64 located one each on either side of the large diameter section of the compressor rotor 40. The stator component 64 consists of laminated ferromagnetic plates sandwiched between triangular wedges arranged radially on a steel disk. Circumferential grooves machined on the face of the bearing accommodate electrical windings. When electrical current flows through the stator coils, a magnetic flux circuit is formed and crosses the gap between the stator and the axial face of the large diameter compressor rotor section. The resultant force causes motion of the compressor rotor in the axial direction. The two stator components 64 which comprise the bearing face in opposite directions prevent movement of the compressor rotor into or out of the compressor.

Sensors

Radial position sensors determine the precise radial position of the rotating structure relative to the stationary compressor housing. The sensors for each radial bearing are located near the bearing on the side opposite the induction motor. The position sensor consists of two components, namely an inductive pickup 62*a* and a ferromagnetic rotor 62*b*. The rotor 62*b* is composed of a pressed stack of laminated plates equal in length to the diameter of the inductive pickup 62*a*. Each bearing requires two inductive pickups, one per bearing axis mounted at 45 degrees from vertical. The pickup senses the change in the thickness of the gap between the pickup 62*a* and the ferromagnetic rotor 62*b*. When the rotor 40*b* is centered, the output signal from the sensor is a minimum.

An axial position sensor 83 determines the precise axial location of the rotating structure relative to the stationary compressor housing. The axial sensor 83 is located at the drive (impeller) end of the centrifugal compressor at a fixed radius from the machine axis. Like the radial position sensors, the axial position sensor 83 uses an inductive pickup to sense changes in the gap thickness between the pickup and a ferromagnetic target. A change in the gap thickness indicates a movement of the rotor from the zero position relative to the stationary compressor housing.

An inductive sensor 81 such as a Hall effect sensor measures the speed of the rotating structure by picking up a once-per-revolution pulse in inductance caused by a notch which has been machined into the circumference of the rotating structure. A frequency counter measures the frequency of the resulting pulse train and converts the result into a measurement of rotor speed.

Auxiliary Bearings

Two sets of angular contact ball bearings 65 support the rotor structure when the magnetic bearings are not powered (inactive), either when the compressor is not operating or the electrical power to the compressor is interrupted due to failure and the like. Each set of bearings 65 consists of two identical angular contact bearings placed in a configuration such that the contact angles intersect. One set of bearings is located at the motor drive end behind the compressor housing. The outer races of the contact bearings are press fit into a sleeve and the sleeve is concentrically mounted into the center of the axial magnetic bearing stator. The inner races of the angular contact bearings 65 do not contact the compressor rotor.

The clearance between the rotor and the inner bearing races is approximately one half the clearance between the stator and rotor components of the radial magnetic bearings. The second set of bearings is located at the non-drive end of the motor. The outer races of the contact bearings 65 are press fit into the hollow end of the compressor rotor. The inner races of the contact bearings ride above the stationary stub shaft concentrically mounted into the center of the axial magnetic bearing stator. The clearance between the inner bearing races and the stub shaft is approximately one half the clearance between the stator and rotor components of the radial magnetic bearings.

Motor Housing

The stationary components of the compressor are contained within the motor housing comprised of three housing sections, namely a drive end radial bearing housing 60 (FIG. 3*d*), a main motor housing 70 (FIG. 3*f*) and a non-drive end bearing housing 80 (FIG. 3*e*) and the end cap 90. Electrical power wiring to the induction motor 45 is passed through hermetic terminals 93 enclosed in a conduit box 91. Electrical power wiring to the magnetic bearing and signal wiring to the position and speed sensing elements are passed through hermetic electrical connectors 94 mounted on the end cap 4. Separate connectors are used for the power and the signal wiring to prevent the high voltage electrical power from interfering with the low voltage signal wiring.

Liquid Motor Cooling

The top surface of the motor housing contains a machined inlet port with a fitting 41*a* (FIG. 3*d*) for condensed refrigerant vapor to provide cooling to the motor cavity. The condensed liquid refrigerant is partially expanded to the intermediate cavity pressure through a valve upstream of the inlet port. The expansion process flashes a portion of the liquid refrigerant to vapor, cooling the remaining liquid/vapor mixture to a lower temperature. The low temperature liquid/vapor mixture flows through cooling passages 72 cast into the motor housing. The passages channel or flow the two-phase mixture to appropriate locations where it evaporatively cools the induction motor 45 and magnetic bearings 61*a*, 61*b*. Additional passages cast into the lower surface of the motor housing collect the warm vapor and channel it to the outlet port with fittings 41*b* (FIG. 3*f*). The two-phase mixture is further expanded to the evaporator pressure through a valve downstream of the outlet port. The intermediate cavity pressure is maintained slightly below the static pressure at the impeller exit to minimize leakage of refrigerant vapor around the impeller to the motor cavity.

Pedestal Mounts

Figure 3G:
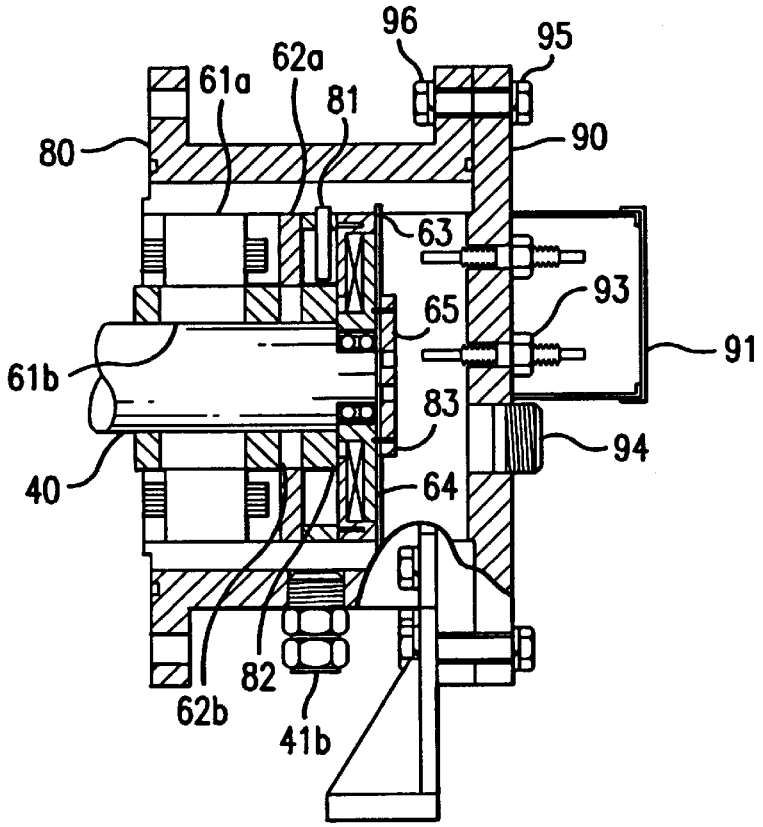
FIG. 3*g* is a partial cross-sectional view of the motor housing and non-drive end radial bearing assembly of the centrifugal compressor of FIG. 3 but showing the interior components on a larger scale.

Two steel foot mounts 92 (FIG. 3*d*) bolted to the exterior of the motor housing 60 provide a solid level base for supporting the weight of the centrifugal compressor. Cap screws 95 secure the end cap to the non-drive end bearing housing 80 (FIG. 3*g*), compressing an O-ring contained in a circumferential machined groove in the end cap 90, between the cap 90 and the motor housing 80. The O-ring seal prevents the escape of refrigerant vapor through the interface between the parts.

Magnetic Bearing Controller

A magnetic bearing controller, 202, actuates the magnetic bearings 61*a*, 64 to maintain the compressor shaft 40 in a stable centered position, both radially and axially, within the housings 60, 70, and 80. The position feedback signal 204 from each position sensor is proportional to that component of the distance of the rotor geometric center from the stator geometric center that lies along the axis of the sensor. When the rotor 40 is centered within the stator, the position feedback signal is zero. The magnetic bearing controller, using a digital signal processor, determines the required bearing currents. These currents are fed to the bearing individually through the magnetic bearing electrical power lines 203. Each bearing axis is controlled by its own set of filters, processors, and amplifiers within the magnetic bearing controller.

Compressor System Controller

The compressor operation is controlled by the chiller system controller 205 which consists of an industrial PC computer, containing a multifunction input/output data acquisition and control (DAQ) board. The compressor system controller runs an algorithm, identified below, that processes input sensor data and sends control signals to the various components of the control system described herein. Through the bearing controller input and output signals 208, 209 respectively, the chiller system controller 205 communicates with the magnetic bearing controller. Through these lines, the chiller system controller gives the commands to start and stop the magnetic bearings, monitors the operating status of the bearings, reads any alarm or warning conditions, and accesses diagnostic and other special functions.

Through the adjustable frequency drive input and output signals 210, 211 respectively,t eh chiller system controller gives the commands to the adjustable frequency drive. Through these signal lines the chiller system controller gives the command to stop and start the compressor motor, monitors operating data, such as line voltage, line current, and real power consumption, reads any alarm and/or warning conditions, and accesses other control functions. The adjustable frequency drive input signal 210 provides the communication from the chiller system control of the desired compressor operating speed to the adjustable frequency drive which uses its internal controller and PID algorithm to control compressor speed by changing the frequency and/or voltage of the compressor power lines 214. The adjustable frequency drive is powered by standard 60 Hz line power 215.

The magnetic bearing controller 202 and the adjustable frequency drive 201 are connected by incoming and outgoing signal lines 212, 213 respectively. Through these lines, alarm and/or warning conditions are communicated instantly whenever they occur to the other component, allowing the controller of the other component to take the appropriate action.

The chiller system controller actuates the inlet guide vanes through the guide vane position and feedback signals 206, 207 respectively. The position of the guide vanes, the speed of the compressors, and the operation of the magnetic bearings are coordinated by a computer algorithm which responds to input data from a variety of sensor signals 216 that monitor conditions within the chiller.

The algorithm, written in National Instruments LabView 4.0 programming language, provides all monitoring, control, and communications functions. It has a graphical user interface which allows the user to monitor operating data when the compressor is running. Its algorithm acquires the operating data, checks for alarms and warnings, calculates the compressor cooling capacity, determines the parameters for position of the inlet guide vanes to match measured capacity with desired capacity, and updates the operating history log. The program provides PID control of the compressor operation.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A method of making a vapor compression refrigeration system, comprising the steps of:

providing a magnetic bearing centrifugal compressor, and employing a refrigerant selected from a group of refrigerants for reducing specific enthalpy rise across the compressor.

2. The refrigerant according to claim 1, wherein the refrigerant is selected for water chiller application.

3. The refrigerant according to claim 1, wherein the refrigerant is further selected to provide compression in a single stage for low cooling capacity applications.

4. A vapor compression refrigeration system, comprising a condenser, an evaporator, an expansion device between an outlet of the condenser and an inlet of the evaporator, a centrifugal compressor supported by magnetic bearings arranged between an outlet of the evaporator and an inlet of the condenser, and a refrigerant selected from a group of refrigerants to reduce specific enthalpy rise of the refrigerant passing through the centrifugal compressor.

5. The system according to claim 4, wherein the magnetic bearings are at least one of sets of radial and axial magnetic bearings.

6. The system according to claim 5, wherein a motor is operatively associated with an impeller of the compressor, and the impeller is configured so as to operate under an acceptable temperature lift condition for the refrigeration system.

7. The system according to claim 6, wherein the motor is an induction motor.

8. The system according to claim 6, wherein a common shaft provides the operative association between the impeller and the motor, and adjustable drive is provided to control efficiency of the system.

9. The system according to claim 6, wherein means is provided for actively monitoring and continuously and simultaneously adjusting the magnetic bearings, axial clearance between the impeller and an impeller shroud, speed of the motor and position of inlet guide vanes of the compressor to maximize system efficiency.

10. The system according to claim 9, wherein said means comprises a variable speed feedback control to vary the speed of the motor.

11. The system according to claim 9, wherein said means is a variable frequency inverter drive.

12. The system according to claim 4, wherein the radial bearings are arranged with the motor therebetween.

13. The system according to claim 4, wherein auxiliary bearings are associated with rotating portions of the compressor so as to be operative during an inactive state of the magnetic bearings.

14. The system according to claim 4, wherein a single stage impeller is cantilevered from a shaft supported by the magnetic bearings.

15. The system according to claim 14, wherein the shaft is a common shaft between the impeller and the motor.

16. The system according to claim 6, wherein the motor is a 2-pole, 3-phase induction motor.

17. The system according to claim 6, wherein the impeller has an equal number of splitter and full-length blades.

18. The system according to claim 13, wherein the auxiliary bearings comprise sets of angular contact ball bearings.

19. The system according to claim 6, wherein stator poles of the motor are configured to throttle the refrigerant therethrough for evaporative cooling of the motor and associated bearings.

20. The system according to claim 19, wherein the motor has a housing with a cooling inlet port for introduction of the refrigerant to the stator poles.

21. The system according to claim 20, wherein the cooling inlet port provides a pressure drop so that the evaporative cooling occurs at a pressure between compressor suction and discharge pressures.

22. A vapor compression system, comprising:

a single stage compressor; and a refrigerant selected from a group of refrigerants to reduce specific enthalpy rise of the refrigerant passing through the system.

23. A method of selecting a refrigerant for use in a vapor compression refrigeration system having a centrifugal compressor, comprising the step of:

choosing a refrigerant from a group of refrigerants to reduce specific enthalpy rise across the compressor.

24. The method according to claim 23, wherein the refrigerant selected is a single component working fluid.

25. The method according to claim 24, wherein the centrifugal compressor is a single stage compressor having radial and axial magnetic bearings.

26. A method of using a vapor compression refrigeration system having a centrifugal compressor, comprising the steps of:

operating magnetic bearings to reduce frictional losses; and passing a refrigerant selected from a group of refrigerants to reduce specific enthalpy rise across the compressor.

27. In a vapor compression refrigeration system having a single stage compressor, the improvement comprising:

a centrifugal compressor having at least one of sets of radial and axial magnetic bearings operable to reduce frictional losses; and a refrigerant selected from a group of refrigerants to reduce specific enthalpy rise of the refrigerant passing through the compressor.

28. The system according to claim 27, wherein an impeller is coupled to the at least one of sets of radial and magnetic bearings in one of an overhung and cantilevered configuration, and two magnetic bearings and a minimum of one thrust bearing is configured to support the refrigeration system.

29. The system according to claim 28, wherein a distance between a periphery of the impeller and a leading edge circle of diffuser vanes is between about 6 to 12% of impeller diameter, which distance is selected to be at a minimum value and controlling fluctuations in shearing forces.

30. The single stage centrifugal compressor to claim 28, wherein a blade angle at a leading edge of blades of the impeller on a shroud side is greater than 25° from a tangential direction thereof.

31. The single stage centrifugal compressor to claim 28, wherein means is provided for actively monitoring and controlling the magnetic bearings, speed of the motor and position of inlet guide vanes of the compressor to maximize compressor efficiency.

* * * * *